United States Patent [19]

Jansen et al.

[11] Patent Number: 4,717,562

[45] Date of Patent: Jan. 5, 1988

[54] PURE SILVER (III) OXIDE

[75] Inventors: Martin Jansen, Hanover; Burkhard Standke, Adenstedt, both of Fed. Rep. of Germany

[73] Assignee: Degussa Aktiengesellschaft, Frankfurt am Main, Fed. Rep. of Germany

[21] Appl. No.: 37,970

[22] Filed: Apr. 14, 1987

Related U.S. Application Data

[62] Division of Ser. No. 797,527, Nov. 13, 1985, Pat. No. 4,695,353.

[30] Foreign Application Priority Data

Nov. 23, 1984 [DE] Fed. Rep. of Germany ..... 3442719

[51] Int. Cl.[4] ..... C01G 5/00

[52] U.S. Cl. ..... 423/604; 204/96; 204/109; 204/110; 204/111

[58] Field of Search ..... 204/83, 86, 96, 109, 204/110, 111; 423/42, 604; 75/118 R

[56] References Cited

U.S. PATENT DOCUMENTS

| | | | |
|---|---|---|---|
| 1,687,056 | 10/1928 | Carl | 204/96 |
| 3,003,935 | 10/1961 | Brown | 204/96 |
| 3,048,469 | 8/1962 | Brown | 204/96 |
| 4,067,788 | 1/1978 | Soloman | 204/96 |
| 4,298,506 | 11/1978 | Przybyla et al. | 423/604 |

FOREIGN PATENT DOCUMENTS

| | | | |
|---|---|---|---|
| 3442719 | 12/1985 | Fed. Rep. of Germany | 423/604 |
| 3025297 | 3/1978 | Japan | 423/604 |

OTHER PUBLICATIONS

Mellon, Joseph William, *Inorganic and Theoretical Chemistry*, vol. III, Longmans Green and Co., London, 1946, pp. 362–380.

Bailar Jr. J. C. *Comprehensive Inorganic Chemistry*, vol. 3, Pergamon Press, 1973, pp. 122–124.

Naraw Szabo, Zeitschrift fur anorganische und allegemeine Chemie, vol. 322, pp. 286–296 (1963).

Gmelin Handbook System No. 61, part B1, pp. 120–121 (1971).

*Primary Examiner*—Robert L. Stoll

*Attorney, Agent, or Firm*—Cushman, Darby & Cushman

[57] ABSTRACT

Silver salts, preferably $AgClO_4$, $AgBF_4$, and $AgPF_6$ are oxidized electrolytically at $-15°$ to $+10°$ C. and a pH between 4.5 and 7.5 with a current density of 40 to 200 $A/m^2$ to produce pure silver (III) oxide.

2 Claims, No Drawings

PURE SILVER (III) OXIDE

This is a division of application Ser. No. 797,527 now U.S. Pat. No. 4,695,353.

BACKGROUND OF THE INVENTION

The invention is directed to a process for the production of silver (III) oxide by anodic oxidation of silver salts in aqueous solutions with current densities of 40 to 2000 $A/m^2$.

There is described in the "Zeitschrift für anorganische und allegemeine Chemie, Vol. 322 (1963), pages 286 to 296" a process for the production of silver (III) oxide phases by anodic oxidation of silver salts in aqueous solution. Thereby dilute $AgNO_3$, AgF, and $AgClO_4$ solutions are oxidized anodically at a pH between 3 and 4 and at room temperature with a current density between 40 and 100 $A/m^2$. Thereby, there is obtained a cubic face centered oxide phase of the "ideal composition" $Ag_2O_3$, which is stable, however, only in the presence of foreign ions and in which $Ag^{3+}$ and $Ag^+$ ions are present in various proportions. Apparently, hereby clathrates were obtained, as is mentioned in "Gmelin Handbuch, System No. 61, part B1(1971) pages 120–121." Silver(III) oxide has previously not been produced in pure form.

Therefore, it was the problem of the present invention to develop a process for the production of silver (III) oxide by anodic oxidation of a silver salt in aqueous solution at a current density of 40 to 2000 $A/m^2$ which permits the recovery of pure silver (III) oxide.

SUMMARY OF THE INVENTION

This problem was solved according to the invention by carrying out the anodic oxidation at a temperature of −15° to +10° C. Especially the anodic oxidation can be carried out at a pH between 4.5 and 7.5.

Preferably, the operating temperature should be between −12° and 0° C. and the pH between 5.5 and 6.5. The process of the invention can be carried out with silver salts with complex ions, except nitrate and sulfate. Advantageously, the silver salts with perchlorate, tetrafluoroborate, or hexafluorophosphate as the anion are used. Besides, it has proven favorable if the silver salt is present in high concentration, as close as possible to the saturation point.

In the electrolysis of an aqueous $AgClO_4$ solution in a platinum shell (as cathode) with an, e.g., 0.3 mm thick platinum wire as the anode at pH 6, 0° C. and a current density of 80 $A/m^2$, there is obtained metallic, glossy, black crystals which were identified analytically and by X-rays as pure $Ag_2O_3$. According to the X-ray analysis, the silver atoms are approximately quadratically planarly coordinated by oxygen atoms, whereby the silver atoms project about 0.09 Å out of the plane defined by the four adjacent oxygen atoms. The $AgO_4$ structural group are coupled via common oxygen atoms to a 3-d cross-linked structure. The average Ag-O-distance is at 2.02 Å.

The thus produced silver (III) oxide, for example, can be used as an oxidation agent, as an active component of the positive electrodes in zinc-silver oxide-primary cells, or as the first stage for obtaining AgO.

The process can comprise, consist essentially of, or consist of the recited steps with the stated materials.

Unless otherwise indicated, all parts and percentages are by weight.

The process of the invention is explained in more detail in the following examples.

DETAILED DESCRIPTION

EXAMPLE 1

A 5 molar solution of $AgClO_4$ (about 50 wt.%) was oxidized anodically at pH 4.5 and a temperature of −10° C. with a current density of 1063 $A/m^2$. As the anode there was employed, a platinum wire having a diameter of 0.3 mm and a length of 500 mm, as cathode a platinum crucible having a diameter of 50 mm. The oxidation was carried out with an electrical voltage of 10 volts and an amperage of 50 mA.

EXAMPLE 2

A 1 molar $AgBF_4$ solution was oxidized anodically at pH 6 and a temperature of −3° C. with a current density of 213 $A/m^2$ in the same apparatus as example 1 (E=10 volts, I=10 mA).

EXAMPLE 3

A 0.01 molar $AgPF_6$ solution was oxidized at 0° C. and pH 7 with a current density of 106 $A/m^2$(E=10 V, I=5 mA).

In all three cases, there were obtained metallic glossy black crystals which were identified as pure silver (III) oxide.

The entire disclosure of German priority application P3442719.8 is hereby incorporated by reference.

What is claimed is:

1. Pure $Ag_2O_3$.
2. $Ag_2O_3$ which is free from $Ag_2O$.

* * * * *